US007994699B2

(12) United States Patent
Iwasaki

(10) Patent No.: US 7,994,699 B2
(45) Date of Patent: Aug. 9, 2011

(54) IMAGE DISPLAY APPARATUS WITH IMPROVED VACUUM CONDITION

(75) Inventor: Kota Iwasaki, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 12/367,962

(22) Filed: Feb. 9, 2009

(65) Prior Publication Data

US 2009/0212701 A1 Aug. 27, 2009

(30) Foreign Application Priority Data

Feb. 25, 2008 (JP) ..... 2008-043069

(51) Int. Cl.
*H01J 1/304* (2006.01)

(52) U.S. Cl. ..... 313/495; 313/496

(58) Field of Classification Search ..... 313/495–497, 313/306, 309–310, 293–304
See application file for complete search history.

(56) References Cited

U.S. PATENT DOCUMENTS

2004/0201349 A1* 10/2004 Ramamoorthi et al. ..... 313/547
2008/0173938 A1* 7/2008 Kubo et al. ..... 257/330

FOREIGN PATENT DOCUMENTS

JP 2000-251729 A 9/2000
WO WO 02065499 * 8/2002

* cited by examiner

*Primary Examiner* — Toan Ton
*Assistant Examiner* — Fatima Farokhrooz
(74) *Attorney, Agent, or Firm* — Fitzpatrick, Cella, Harper & Scinto

(57) ABSTRACT

An image display apparatus includes at least one electron-emitting device, at least one wiring arranged to apply a voltage to the electron-emitting device, a getter disposed on the wiring, and an insulating layer interposed between the getter and wiring. The getter has penetrating portions formed in a part thereof corresponding to a region where an image is displayed in the image display apparatus. The penetrating portions are at least one opening, and an area of an inner wall surface of the getter facing the opening is substantially the same as or larger than an area of the opening.

7 Claims, 9 Drawing Sheets

IMAGE DISPLAY APPARATUS WITH IMPROVED VACUUM CONDITION

BACKGROUND OF THE INVENTION

1. Field

The present disclosure relates to an image display apparatus, and more particularly to an image display apparatus including an electron-emitting device.

2. Description of the Related Art

There is known a flat image display apparatus in which electrons emitted from electron-emitting devices are irradiated to phosphors, whereupon the phosphors generate light to display an image. In such an image display apparatus, the interior is held at a high vacuum state. If gas is generated inside the image display apparatus and pressure is increased, the electron-emitting devices can be adversely affected and, as a result, the image display apparatus cannot be manufactured in a satisfactory manner.

In view of such a situation, Japanese Patent Laid-Open No. 2000-251729 proposes a structure in which a getter is deposited on wirings within an image display region of the image display apparatus, with an insulating layer interposed therebetween.

SUMMARY

The inventors herein have noticed that with the above-described structure including a getter deposited on wirings with an insulating layer interposed therebetween, an electrostatic capacitance is necessarily generated. If the electrostatic capacitance is increased, a pulse-like drive signal applied to the electron-emitting devices can become distorted due to ringing. As a result, image quality deteriorates.

The deterioration of image quality, which is caused by electrostatic capacitance, is considered to be preventable by eliminating the getter, i.e., by not depositing the getter on the wirings. However, when no getter is deposited on wirings occupying a large area on a substrate on which electron-emitting devices are disposed, it can be difficult to achieve a high vacuum condition near the electron-emitting devices.

An exemplary embodiment of the present invention provides an image display apparatus in which a high vacuum condition is achieved near electron-emitting devices.

According to one exemplary embodiment of the present invention, an image display apparatus includes at least one electron-emitting device, at least one wiring arranged to apply a voltage to the electron-emitting device, and a getter disposed on the wiring, and an insulating layer interposed therebetween, wherein the getter has penetrating portions formed in a part thereof corresponding to a region in which an image is displayed in the image display apparatus, the penetrating portions are at least one opening, and an area of an inner wall surface of the getter facing the opening is substantially the same as or larger than an area of the opening.

According to another exemplary embodiment of the present invention, an image display apparatus includes at least one electron-emitting device, at least one wiring arranged to apply a voltage to the electron-emitting device, and a getter disposed on the wiring, and an insulating layer interposed therebetween, wherein the getter has penetrating portions formed in a part thereof corresponding to a region in which an image is displayed in the image display apparatus, the penetrating portions are at least one cut groove, and an area of an inner wall surface at the cut groove is substantially the same as or larger than an area of the cut groove.

According to still another exemplary embodiment of the present invention, an image display apparatus includes at least one electron-emitting device, at least one wiring arranged to apply a voltage to the electron-emitting device, and a getter disposed on the wiring, and an insulating layer interposed therebetween, wherein the getter has penetrating portions formed in a part thereof corresponding to a region in which an image is displayed in the image display apparatus, and the penetrating portions have shapes that cause the getter to resist deterioration of adsorption performance away from a level obtained in a case where a getter having no penetrating portions is used in the device.

With the exemplary embodiments of the present invention, a high vacuum condition near the electron-emitting device can be achieved.

Further features of the present invention will become apparent from the following description of exemplary embodiments with reference to the attached drawings.

DESCRIPTION OF THE EMBODIMENTS

Several exemplary embodiments will be described below with reference to the accompanying drawings. However, it should be understood that aspects of the invention are not limited to those examples only, which are described for illustration purposes.

First Exemplary Embodiment (Structure of Image Display Apparatus)

Figure 1:
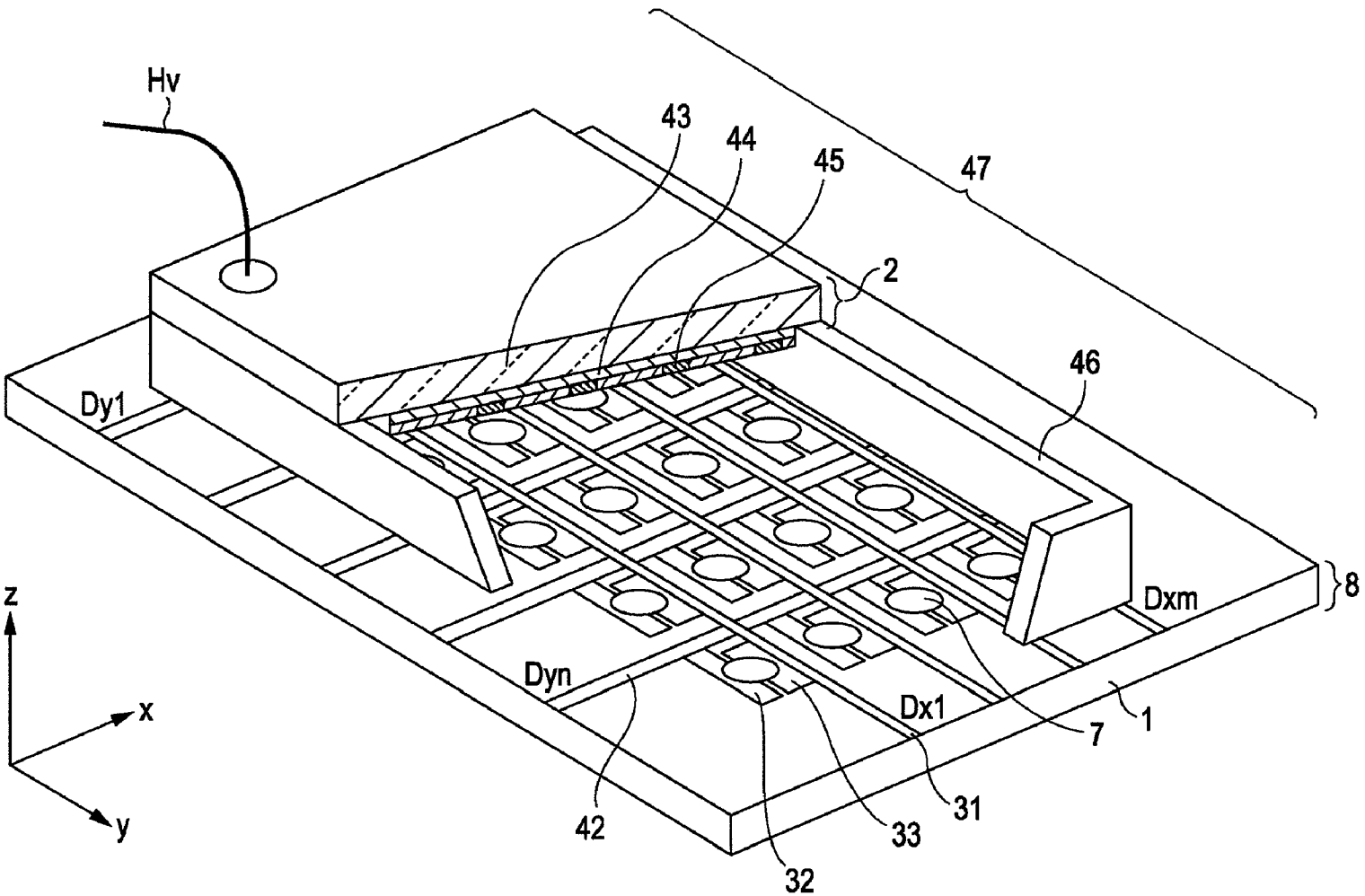
FIG. 1 illustrates an overall structure of an image display apparatus according to a first exemplary embodiment.

FIG. 1 is a perspective view, partly cut away, illustrating one example of an overall structure of an image display apparatus according to a first exemplary embodiment.

According to the first exemplary embodiment, as illustrated in FIG. 1, a vacuum container 47 is constructed by a rear plate 8 and a face plate 2 with a support frame 46 sandwiched between both the plates.

The rear plate 8 includes, at least, an electron source substrate 1 and components disposed on the electron source substrate 1, i.e., electron-emitting devices 7, electrical connection terminals Dx1 to Dxm and Dy1 to Dyn, column wirings 31, row wirings 42, and/or device electrodes 32 and 33. The electrical connection terminals Dx1 to Dxm and Dy1 to Dyn serve as terminals for supplying electric power to the electron-emitting devices 7 from the outside of the vacuum container 47. The device electrodes 33 (on the high-voltage side) and the device electrodes 32 (on the low-voltage side) are electrically connected to the column wirings 31 and the row wirings 42, respectively, and are electrically connected to the electron-emitting devices 7 as well. Through the device electrodes 32 and 33, voltages are applied to the electron-emitting devices 7 from the outside of the vacuum container 47. In this exemplary embodiment, surface-conduction electron-emitting devices are employed as the electron-emitting devices 7, although other types of electron-emitting devices may be employed instead.

The face plate 2 includes, at least, a transparent substrate 43, such as a glass plate, and components disposed on the transparent substrate 43, i.e., a phosphor film 44 and a metal back 45. The metal back 45 is a thin film which not only serves as an electrode, but also reflects emitted light, and which allows electron beams emitted from the electron-emitting devices 7 to pass through it. The electron beams having passed through the metal back 45 to which a high voltage is applied are irradiated to the phosphor film 44, whereupon the phosphor film 44 emits light to display an image.

Further, a high-voltage terminal Hv is disposed as an electrical connection terminal which supplies electric power to the metal back 45 from the outside of the vacuum container 47. The electrical connection terminal has an airtight structure.

Though not shown in FIG. 1, a getter described below is further deposited on the rear plate 8.

(Cross-Section of Portion Including Wirings)

Figure 2:
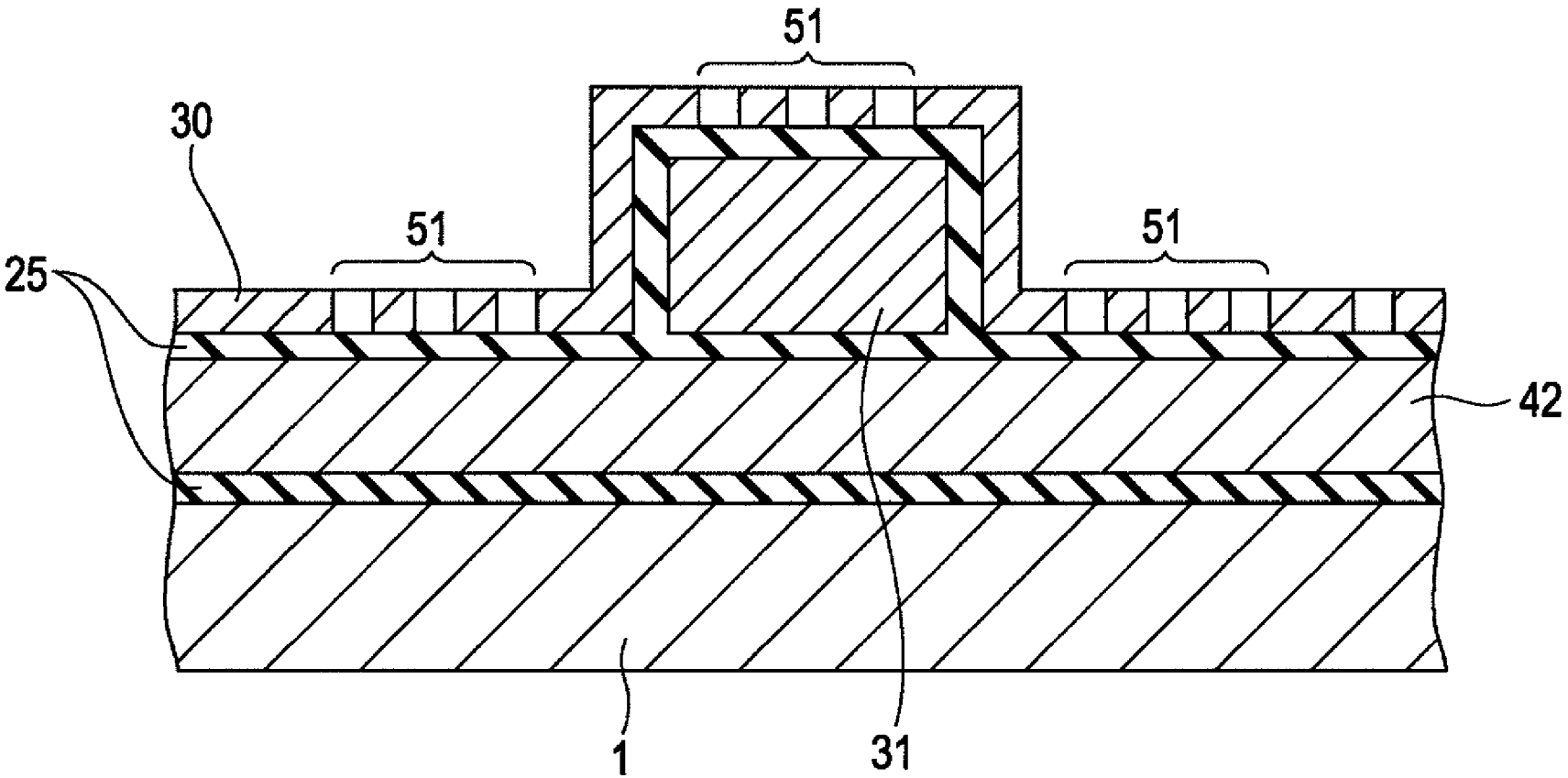
FIG. 2 is a cross-sectional view of the image display apparatus according to the first exemplary embodiment.

FIG. 2 is a cross-sectional view, taken along the row wiring 42, of a portion in which the column wiring 31 and the row wiring 42 intersect in FIG. 1. In this view illustrated in FIG. 2, a getter 30 is deposited on row wiring 42, with an insulating layer 25 interposed therebetween. Although in FIG. 2 the getter 30 is shown deposited on the row wiring 42, in this and/or other embodiments, the getter 30 may be deposited on column wiring 31 or on both of row wiring 42 and column wiring 31, with an insulating layer disposed therebetween.

Generally, in an image display apparatus having electron-emitting devices, gases typically present within a vacuum container include gas remaining after sealing and gases released from various members within the vacuum container, such as $H_2$, $CH_4$, $H_2O$, CO, $CO_2$ and $N_2$. Ti, Ba, V, Zr, Fe, Pd, Ni, Mn, Co, etc. can be used alone or in the form of an alloy as the getter 30 for adsorbing those gases. Performance of the getter 30 to adsorb those gases, such as $CH_4$, $H_2O$, CO, $CO_2$ and $N_2$ can depend significantly on a surface area of the getter 30.

To achieve a high vacuum condition near the electron-emitting devices 7, in this exemplary embodiment, the getter 30 is deposited in part of a region where an image is to be displayed in the image display apparatus and where a vacuum condition is to be held, except for locations just above the electron-emitting devices 7.

Herein, the region where an image is (to be) displayed can mean, in one example, a region interconnecting outermost ones of the electron-emitting devices 7 arrayed in a matrix pattern.

The getter 30 can be an evaporable getter or a non-evaporable getter.

Use of the non-evaporable getter can be helpful in improving pattern accuracy and increasing productivity because, in addition to the mask technique, the liftoff technique based on photolithography can also be used for patterning. The non-evaporable getter can be formed on the wirings by, e.g., electron-beam deposition or sputtering.

(Shape of Getter)

Figure 3:
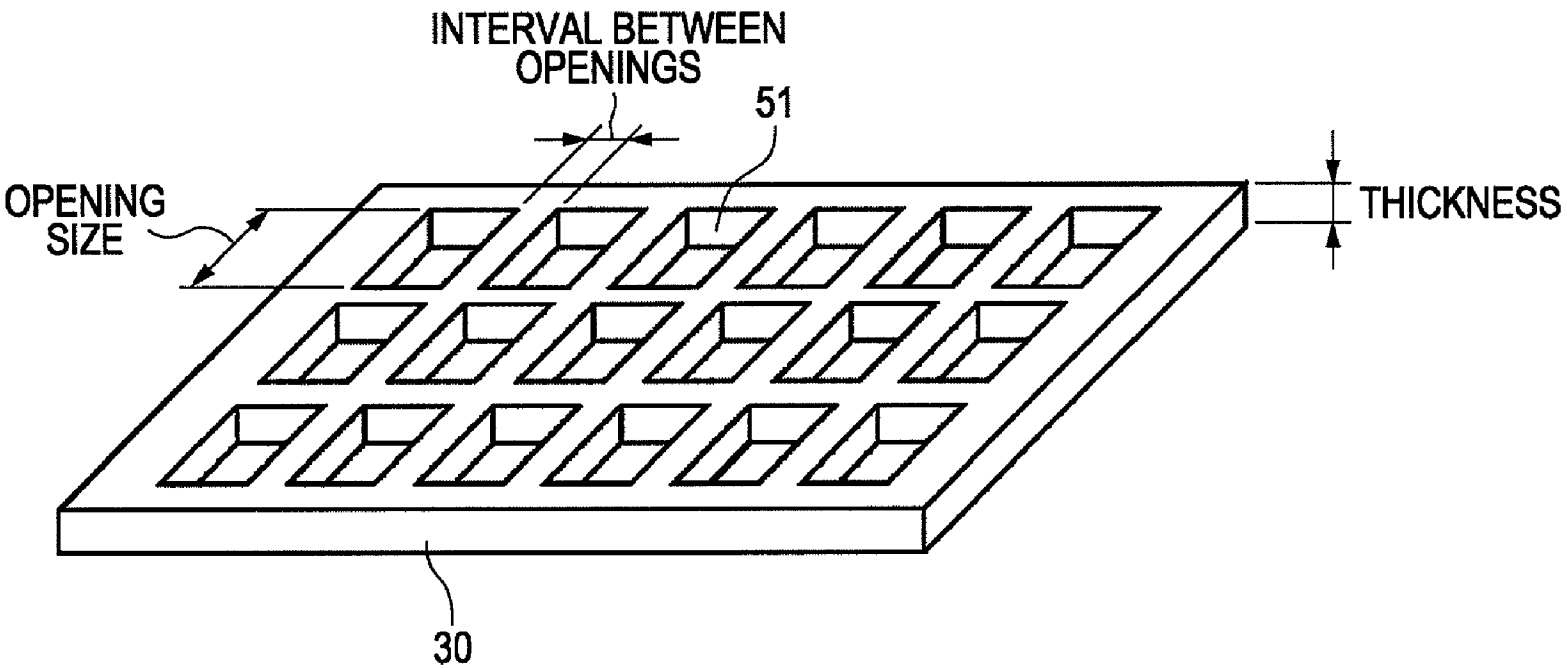
FIG. 3 illustrates the shape of a getter in the first exemplary embodiment.

FIG. 3 illustrates the three-dimensional shape of the getter 30 that can be deposited on wirings in an exemplary embodiment.

As illustrated in FIG. 3, the getter 30 has penetrating portions, or openings, which penetrate through the getter 30. In this exemplary embodiment, rectangular openings 51 are provided as the penetrating portions, although in other embodiments, openings having shapes other than rectangular can be employed. Because the getter 30 is deposited in the part of the image-display region where a vacuum condition is to be held, except for locations just above the electron-emitting devices 7, the openings 51 can also be patterned at the same time as when the liftoff technique using a photoresist is performed. The patterning can also be performed using the mask technique instead of the liftoff technique.

The insulating layer positioned under the openings 51 can be removed by, e.g., etching. Alternatively, the insulating layer can be left as it is, without being removed.

With this exemplary embodiment, since the getter 30 having the penetrating portions is disposed on the wirings, a projected area of the getter 30 as viewed in the direction normal to the rear plate 8 can be reduced in comparison with that in the case where a getter having no penetrating portions is disposed on the wirings. It is noted that the term "projected area" can be defined by orthographically-projecting the getter onto the substrate. As a result, the electrostatic capacitance generated between the wirings, such as the row wirings 42 and the column wirings 31, and the getter 30 can be reduced.

According to one example embodiment, in a part of the image-display region located a predetermined distance away from the wirings where electrostatic capacitance generated by the getter does not present a concern, the getter does not need to have the penetrating portions.

The getter having the penetrating portions can have a smaller projected area than a getter having no penetrating portions, when viewed in the direction normal to the rear plate 8. Therefore, gas adsorption performance of the former getter is generally reduced. The inventor, however, has discovered a structural feature which does not reduce gas adsorption performance, even where the projected area of the getter is reduced. Such a structural feature will be described in detail below with reference to FIG. 4.

Figure 4:
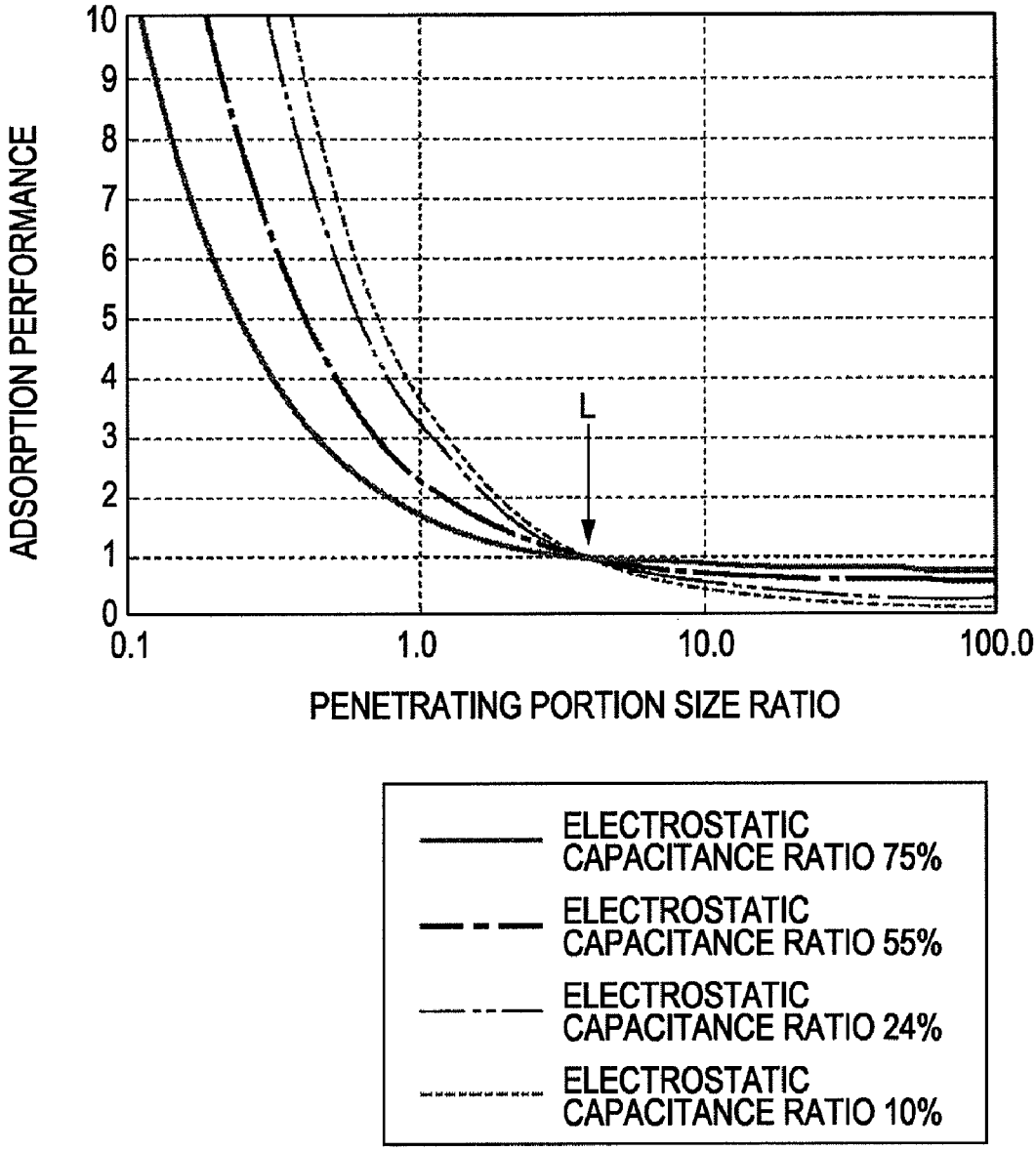
FIG. 4 is a graph illustrating changes of adsorption performance with respect to a penetrating portion size ratio in the first exemplary embodiment.

In the graph of FIG. 4, the horizontal axis represents a penetrating portion size ratio, i.e., a ratio of an opening (penetrating portion) size (described below) to a thickness of the getter 30 in this exemplary embodiment. The vertical axis represents a ratio of the gas adsorption performance of the getter 30 having the openings 51 to that of a getter which has the same sizes and shapes as the getter 30 except for the inclusion of the openings 51.

Herein, the gas adsorption performance depends on a gas adsorption rate as an index. The gas adsorption rate is given by G(t) in the following formula;

$$V\cdot(dp/dt)=Q(t)-p\cdot G(t)$$

where V is the volume of a vacuum container in which the getter is to be deposited, p is the pressure in the container, and Q(t) is the amount of gases released from members forming the container.

In this exemplary embodiment, the openings 51 are each formed in a square shape and the length of one side of the square shape is defined as the opening size (see FIG. 3). The electrostatic capacitance depends on the opening size and the interval between the openings (see FIG. 3). Four curves in the graph of FIG. 4 indicate changes of the gas adsorption performance with respect to the penetrating portion size ratio when a ratio of the electrostatic capacitance generated by the getter according to this exemplary embodiment to that generated by the getter having no openings is set to 10%, 24%, 55%, and 75%. Those curves are obtained on condition that the gas adsorption performance is proportional to the surface area of the getter.

The graph of FIG. 4 implies that, in the getter 30 having the openings 51 which satisfy the condition of the gas adsorption performance being equal to or more than 1, the gas adsorption performance is not reduced in comparison with that in the case where the getter having no penetrating portions is used, while the projected area of the getter is reduced.

As seen from the graph of FIG. 4, when the penetrating portion size ratio is set to a certain value L (L=4 in this exemplary embodiment), the gas adsorption performance takes a ratio of 1 regardless of the electrostatic capacitance ratio that is determined depending on the interval between the openings. This is because L=4 represents the case where the area of the opening 51 (i.e., the projected area of the opening 51 as viewed in the direction normal to the rear plate 8) is equal to the area of an inner wall surface of the opening 51.

Thus, in this exemplary embodiment, by depositing, on the wirings, the getter 30 having the openings 51 which are formed to satisfy the condition of the penetrating portion size ratio being equal to or smaller than L, the electrostatic capacitance generated between the wirings and the getter 30 can be reduced without deteriorating the gas adsorption performance. As a result, a high vacuum condition (such as $10^{-5}$ Pa or more) near the electron-emitting devices can be achieved.

The reason why the electrostatic capacitance can be reduced without deteriorating the gas adsorption performance resides in the gas adsorption effect provided by the inner wall surface of each opening 51. More specifically, the reason is that when the penetrating portion size ratio is set to a value smaller than L, the area added by the inner wall surfaces of the openings 51 becomes larger than an amount by which the projected area of the getter 30 is reduced owing to the presence of the openings 51 therein. This implies that the condition for reducing the electrostatic capacitance generated between the getter 30 and the wirings, in comparison with that in the case where the getter having no penetrating portions is used, without deteriorating the gas adsorption performance, can be determined depending on setting of the shape and/or size of the opening 51 and the thickness of the getter 30. Stated another way, in this exemplary embodiment, an upper limit value of the penetrating portion size ratio is L. Further, in this first embodiment, the shape of the penetrating portion is defined by the shape of the individual openings formed in the getter and the thickness of the getter. In addition, the thickness of the getter is desirably 1 μm or less, although the thickness can have other values.

Second Exemplary Embodiment

Figure 5:
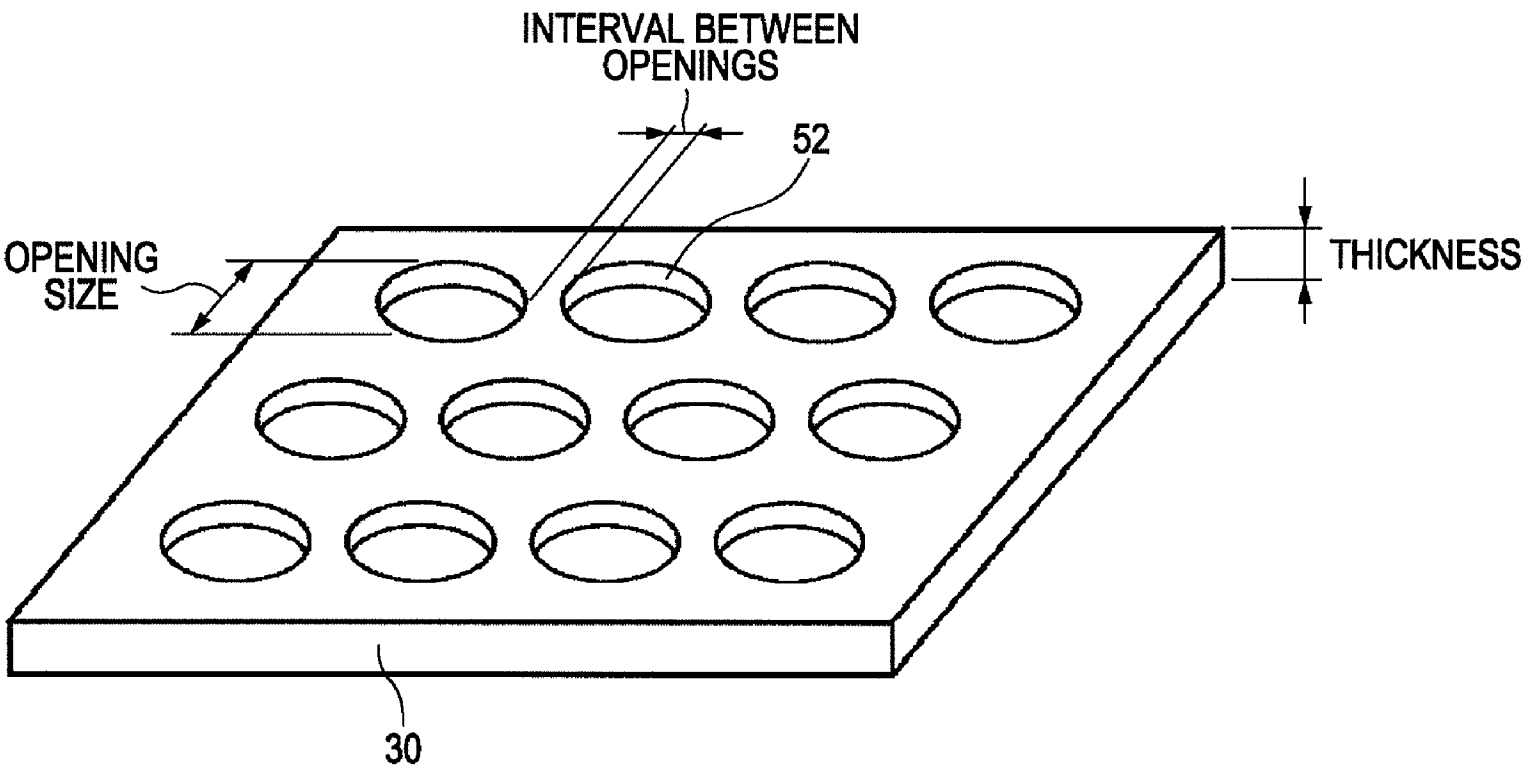
FIG. 5 illustrates the shape of a getter in a second exemplary embodiment.

FIG. 5 illustrates the three-dimensional shape of a getter 30 to be deposited on wirings in a second exemplary embodiment.

This second exemplary embodiment differs from the first exemplary embodiment in that circular openings 52, which define cylinders, are formed as the penetrating portions in the getter 30.

Figure 6:
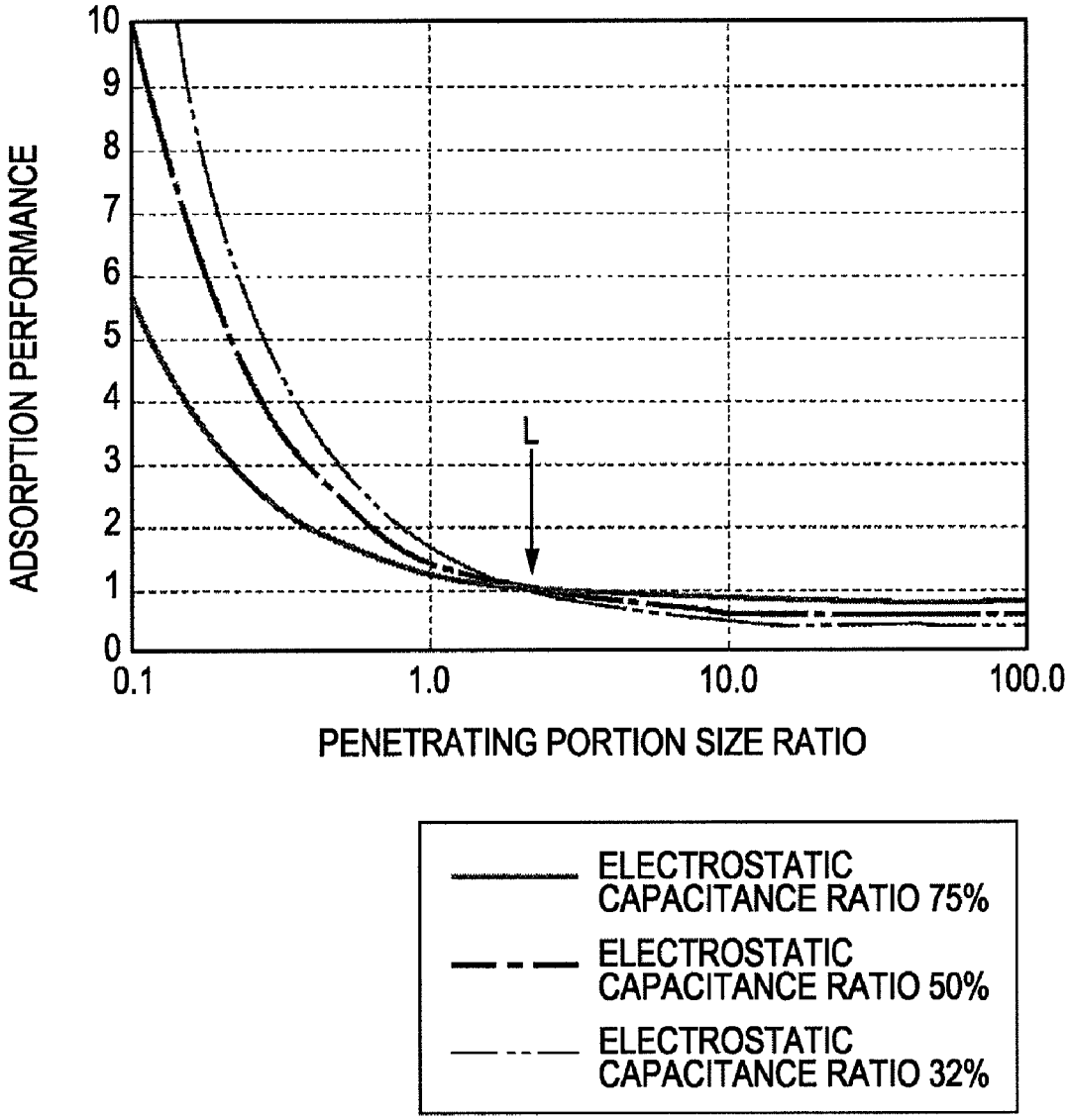
FIG. 6 is a graph illustrating changes of adsorption performance with respect to the penetrating portion size ratio in the second exemplary embodiment.

FIG. 6 is a graph illustrating changes of gas adsorption performance with respect to the penetrating portion size ratio in the second exemplary embodiment. The vertical axis and the horizontal axis represent the same parameters as those in the graph of FIG. 4. In the second exemplary embodiment, the radius of the circuit opening 52 is defined as the opening size parameter introduced above. Three curves in the graph of FIG. 6 indicate changes of the gas adsorption performance with respect to the penetrating portion size ratio when a ratio of the electrostatic capacitance generated by the getter according to the second exemplary embodiment to that generated by a similar getter having no penetrating portions is set to 32%, 50%, and 75%.

As seen from the graph of FIG. 6, in this second exemplary embodiment, when the penetrating portion size ratio is set to a certain value L (L=2 in this second exemplary embodiment), the gas adsorption performance takes a ratio of 1 regardless of the electrostatic capacitance ratio determined based on the interval between the openings, as in the first exemplary embodiment.

Thus, also in this second exemplary embodiment, the electrostatic capacitance generated between the wirings and the getter 30 can be reduced without deteriorating the gas adsorption performance. Such a result is attributable to the gas adsorption effect provided by an inner wall surface of each opening 52. More specifically, the reason is that when the penetrating portion size ratio is set to a value smaller than L, an amount by which the area of the inner wall surfaces of the openings 52 is increased becomes larger than an amount by which the projected area of the getter 30 is reduced because of the presence of the openings 52 formed therein.

Where an area of figures having various shapes is constant, a circle is a figure having a minimum circumferential length (length of outer edge of the figure). Hence the contribution of the inner wall surfaces of the circular openings 52 to the gas adsorption effect also is at minimum. However, the circular openings 52 can be helpful in suppressing contamination of the getter 30 and improving a discharge-resistant characteristic, because circular openings have no sharp edges and are effective to minimize or reduce a possibility that residues of a resist and particles will be generated.

Also in this second exemplary embodiment, the shape of the penetrating portion is defined by the shape of the opening formed in the getter 30 and the thickness of the getter 30.

Third Exemplary Embodiment

Figure 7:
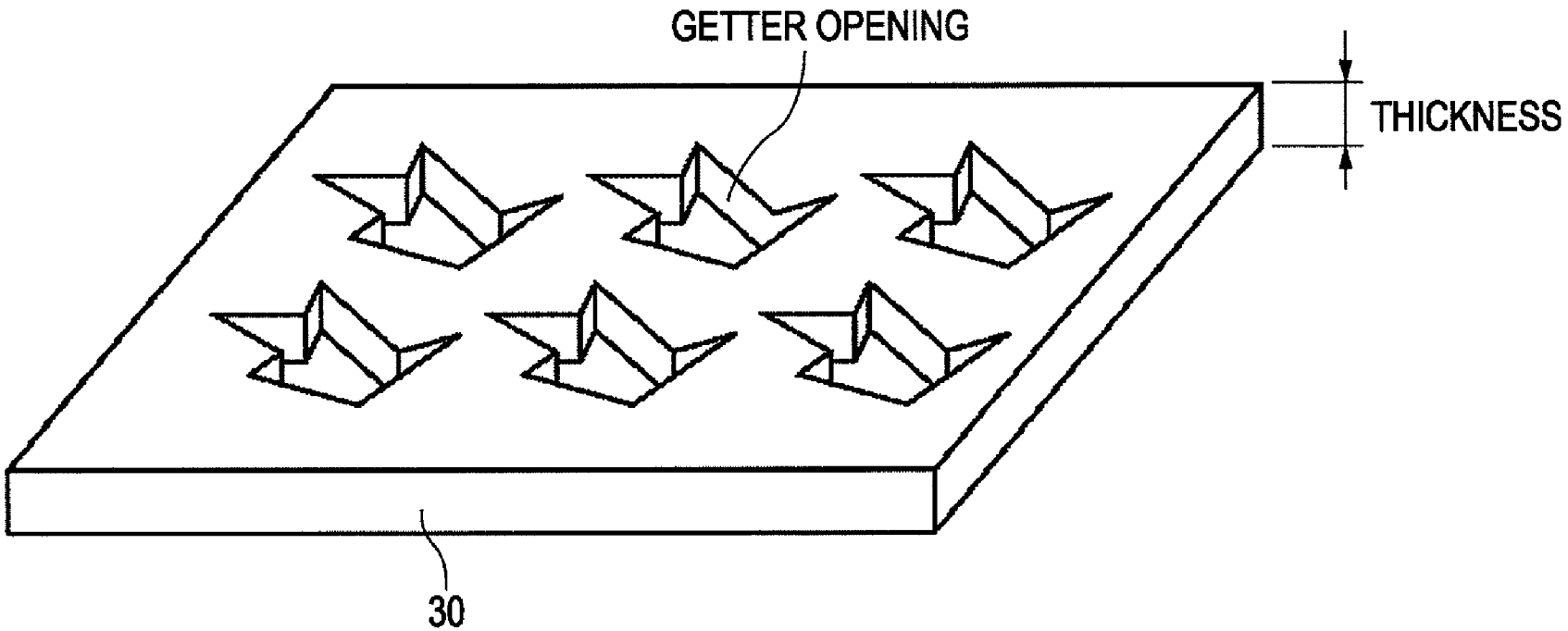
FIG. 7 illustrates the shape of a getter in a third exemplary embodiment.

FIG. 7 illustrates the three-dimensional shape of a getter 30 to be deposited on wirings, in a third exemplary embodiment.

As described above in connection with the first and second exemplary embodiments, the opening size can be determined such that, even when the openings formed in the getter have any of different shapes, the electrostatic capacitance is reduced without deteriorating the gas adsorption performance.

Stated another way, even when the getter has, as the penetrating portions, openings having a complicated shape such as, e.g., that illustrated in FIG. 7 according to this third exemplary embodiment, the electrostatic capacitance can be reduced without deteriorating the gas adsorption performance by selecting an appropriate opening size, as in the above-described exemplary embodiments.

Thus, an arbitrary shape can be selected as the shape of the opening so long as the selected shape satisfies the condition that the area added by the inner wall surface of the opening (the entire surface facing the opening) is larger than the projected area of the opening as viewed in the direction normal to the rear plate. Further, the getter is not limited to having only openings having the same shape, and a plurality of openings having different shapes can be formed in the getter in other embodiments. In addition, the opening size and the interval between the openings need not be set to be constant.

Also in this third exemplary embodiment, the shape of the penetrating portion is defined by the shape of the opening formed in the getter and the thickness of the getter.

While, in the above-described exemplary embodiments, surface-conduction electron-emitting devices are described as being employed as the electron-emitting devices 7, other embodiments are not necessarily limited to using surface-conduction electron-emitting devices.

For example, field effect electron-emitting devices of Spindt-type or the like and electron-emitting devices of metal/insulating layer/metal-type can also be employed.

Other embodiments can be practiced regardless of whether a getter potential is specified or not. However, it is often more desirable if the getter potential is specified. In particular, by electrically connecting the getter, which is deposited in the region where an image is displayed in the image display apparatus, to a ground electrode or a potential specifying electrode, the getter potential ordinarily can be prevented from being affected by the potential at the wiring. Further, since charging of the getter is largely suppressed by specifying the getter potential, variations of electric fields near the electron-emitting devices can be held down and the trajectory of each electron beam can be stabilized. In addition, if discharge occurs between the face plate 2 and the rear plate 8, a discharge current is caused to flow into the potential specifying electrode from the getter, whereby an overcurrent can be prevented from flowing into a circuit that drives the electron-emitting devices.

Fourth Exemplary Embodiment

Figure 8:
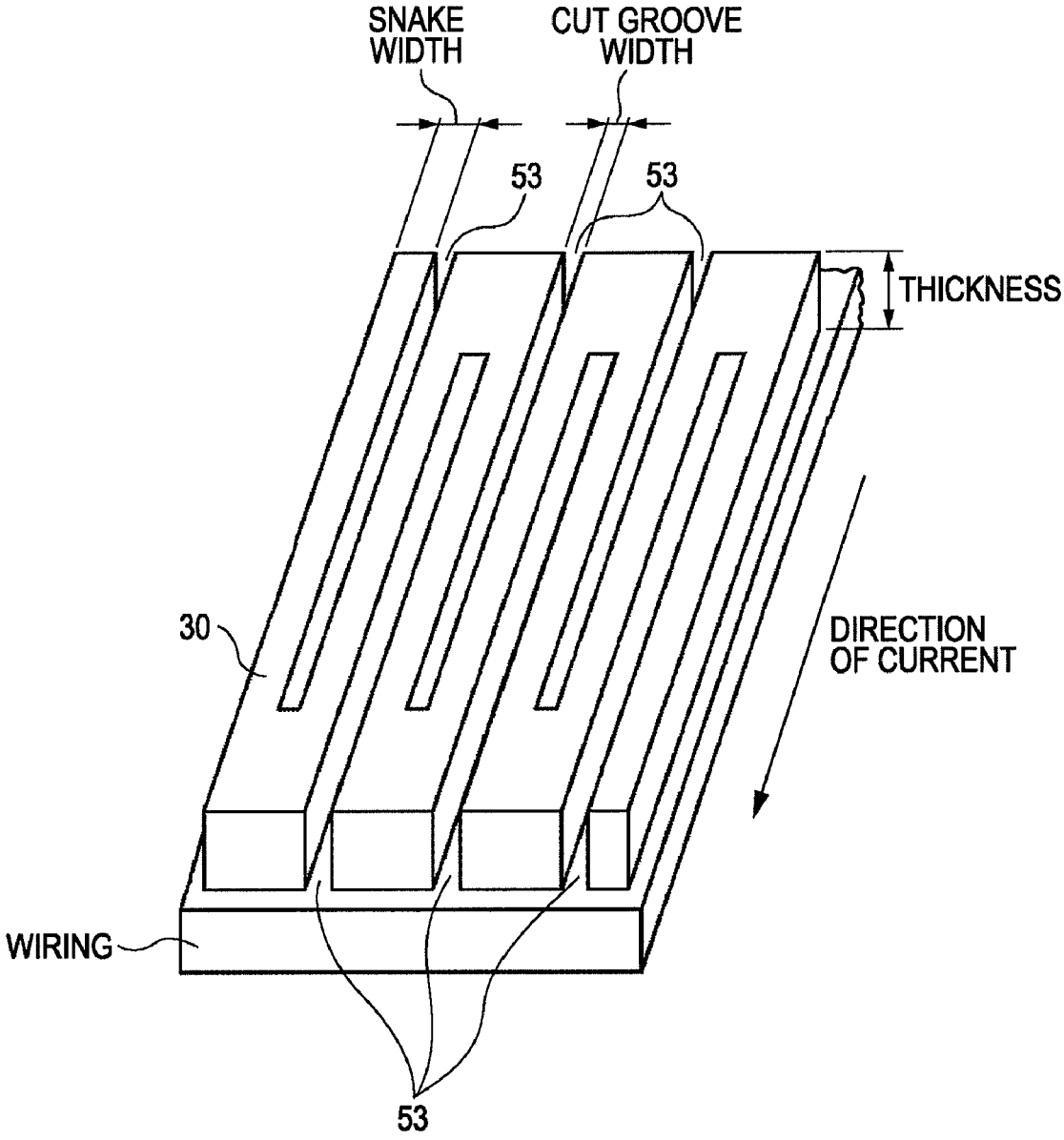
FIG. 8 illustrates the shape of a getter in a fourth exemplary embodiment.

FIG. 8 illustrates the three-dimensional shape of a getter 30 deposited on at least one wiring in a fourth exemplary embodiment.

This fourth exemplary embodiment differs from the above-described exemplary embodiments in that it employs a getter having, as the penetrating portions, cut grooves 53 instead of the openings described above. The cut grooves 53 are formed in the getter 30 such that the getter has a snake-like shape as a whole. In this fourth exemplary embodiment, six cut grooves (represented as "cut groove width" in FIG. 8) are formed in a zigzag pattern to be alternately opened to opposite sides of the getter 30, as illustrated in FIG. 8. The six cut grooves are formed at equal intervals so as to provide a shape having a constant "snake width", as represented in FIG. 8.

Figure 9:
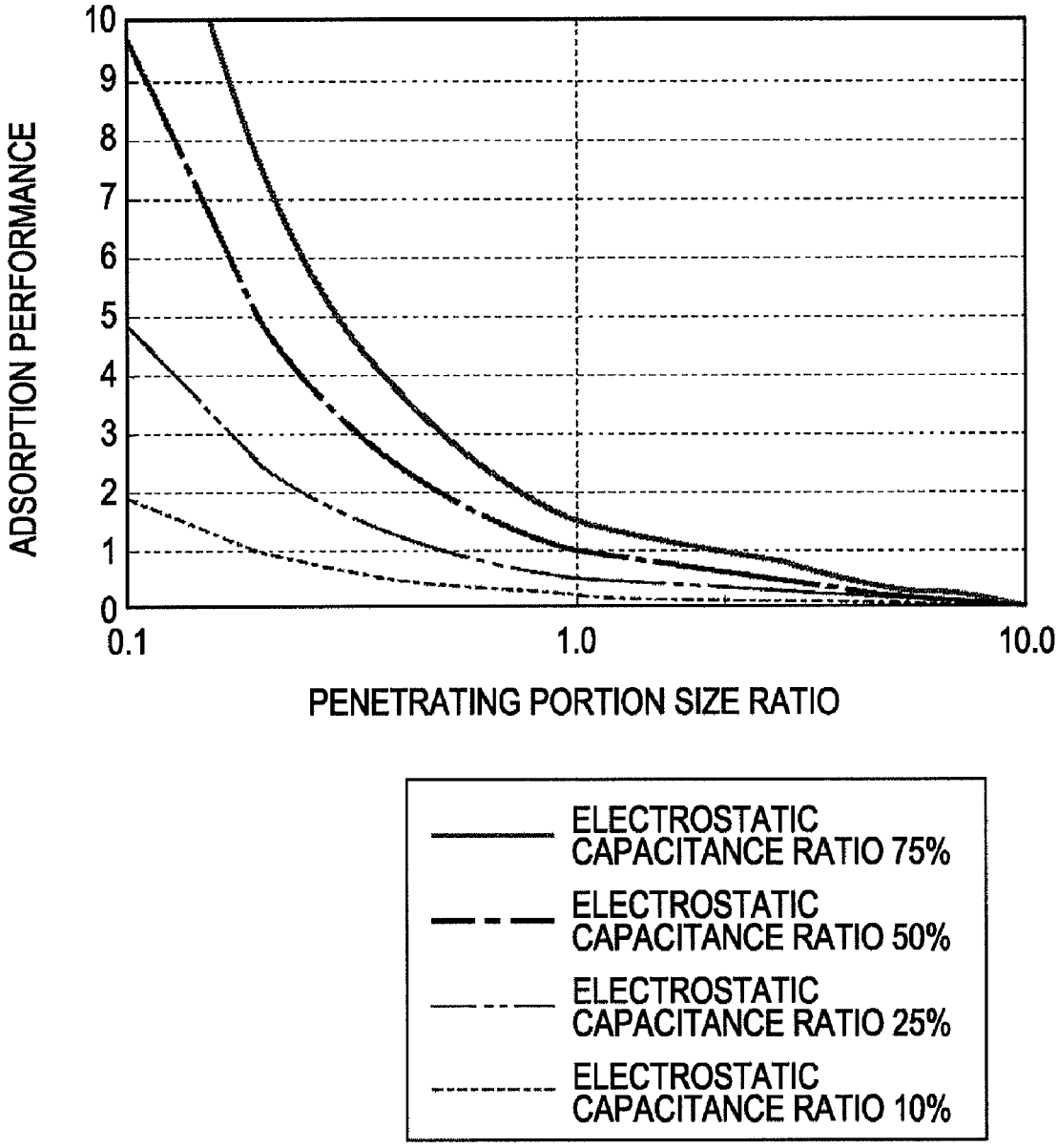
FIG. 9 is a graph illustrating changes of adsorption performance with respect to the penetrating portion size ratio in the fourth exemplary embodiment.

FIG. 9 is a graph illustrating changes of gas adsorption performance with respect to the penetrating portion size ratio in this fourth exemplary embodiment. In the graph of FIG. 9, the horizontal axis represents a penetrating portion size ratio, i.e., a ratio of a snake width to a thickness of the getter 30. The vertical axis represents a ratio of the gas adsorption performance of the getter 30 having the cut grooves 53 to that of a similar getter but having no penetrating portions. In this fourth exemplary embodiment, the getter 30 has the cut grooves 53 extending parallel to a direction in which a current flows in the wiring(s). Herein, the electrostatic capacitance generated between the getter 30 and the wiring depends on the snake width and the width of the cut groove 53 (i.e., the cut groove width). Four curves in the graph of FIG. 9 indicate changes of the gas adsorption performance with respect to the penetrating portion size ratio when a ratio of the electrostatic capacitance generated by the getter according to this fourth exemplary embodiment to that generated by the similar getter having no penetrating portions is set to 10%, 25%, 50%, and 75%.

In this exemplary embodiment, by depositing, on the wiring(s), the getter 30 having the cut grooves 53 which are formed so as to provide a gas adsorption performance ratio of 1 or more, the electrostatic capacitance generated between the wiring(s) and the getter 30 can be reduced without deteriorating the gas adsorption performance. Such a result is attributable to the fact that the area added by an inner wall surface at the cut groove is equal to or larger than the projected area of the cut groove as viewed in the direction normal to the rear plate (e.g., plate 8 of FIG. 1). As a result, a high vacuum condition near the electron-emitting devices can be achieved.

The direction in which the cut grooves extend is not limited to that discussed above for this fourth exemplary embodiment, i.e., to the direction of the electric current. For example, in other embodiments the cut grooves can be formed to extend in a direction perpendicular to the direction of the current in the wiring, or at another orientation relative to that current.

It can be helpful, however, in this fourth exemplary embodiment, that an even number of cut grooves be formed to extend parallel to the direction of the current in the wiring(s), and be arranged in a zigzag pattern to provide alternate openings to opposite sides of the getter. With the getter having those cut grooves, currents induced in reciprocating directions of the zigzag pattern are caused to cancel each other. As a result, inductance can also be reduced in addition to the reduction in electrostatic capacitance generated between the wiring(s) and the getter.

In this fourth exemplary embodiment, the shape of the penetrating portion is defined by the shape of the cut groove formed in the getter and the thickness of the getter.

While the getter having the cut grooves as the penetrating portions is used in the above-described fourth exemplary embodiment, in other embodiments the getter also can include, as the penetrating portions, not only the cut grooves, but also one or more of the other types of openings described herein.

Further example embodiments will now be described in detail below.

Example 1

In Example 1, the image display apparatus, shown in FIGS. 1 and 2, is fabricated. The row wirings 42 are formed with a line width of 300 μm at intervals of 600 μm. The column wirings 31 are formed with a line width of 30 μm at intervals of 200 μm. The electron-emitting devices 7 are connected in a matrix pattern by using the row wirings 42 and the column wirings 31. Surface-conduction electron-emitting devices are employed as the electron-emitting devices 7.

The insulating layer 25 (FIG. 2) made of $SiO_2$ is formed on the row wirings 42 and the column wirings 31. Further, a resist film is formed at positions where the openings of the getter are to be located, and a Ti film is formed thereon with a thickness of about 1 μm by sputtering. Thereafter, the Ti film on the resist is peeled off together with the resist by the liftoff technique. The getter 30 having the openings is thus formed.

In Example 1, the getter having the square openings 51, shown in FIG. 3, as the penetrating portions is formed. The length of one side of the square opening 51 is set to 4 μm, and the interval between the openings 51 is set to 0.5 μm. The thickness of the getter 30 is set to 1 μm.

After evacuating the interior of the vacuum container 47 by a vacuum pump, for example, the getter 30 is heated to about 350° C. for activation of the getter 30. The activation causes the getter 30 to develop gas adsorption performance.

The electrostatic capacitance generated between the wirings and the getter 30 having the openings 51 in Example 1 is reduced to 55% of that generated between the wirings and the getter were it to have no penetrating portions. On the other hand, the gas adsorption performance of the getter 30 having the openings 51 is comparable to that of the getter having no penetrating portions.

According to Example 1, the electrostatic capacitance generated between the wirings and the getter 30 can be reduced in comparison with that in the case where a getter having no penetrating portions is used, without deteriorating the gas adsorption performance. As a result, a high vacuum condition near the electron-emitting devices can be achieved.

For the electrostatic capacitance generated between the wirings and the getter to be further reduced, the design can be modified, for example, such that the length of one side of the square opening is set to 4 μm and the interval between the square openings is set to 0.15 μm. With that design, the electrostatic capacitance generated between the wirings and the getter 30 is reduced to 25% of that generated between the wirings and a getter having no penetrating portions. On the other hand, the gas adsorption performance of the getter 30 is held comparable to that of the getter having no penetrating portions.

Alternatively, to make the gas adsorption performance of the getter 30 further increased, the design can be modified, for example, such that the length of one side of the square opening is set to 1 μm and the interval between the openings 51 is set to 0.5 μm. With that design, the electrostatic capacitance generated between the wirings and the getter 30 is reduced to 50% of that generated between the wirings and the getter having no penetrating portions. On the other hand, the gas adsorption performance of the getter 30 is increased to about 2.3 times that of the getter having no penetrating portions.

Example 2

Example 2 is similar to Example 1 except that in Example 2, circular openings 52, such as those shown in FIG. 5, are formed as the penetrating portions.

In Example 2, the radius of the circular opening 52 is set to 2 μm, and the interval between the openings 52 is set to 0.5 μm. The electrostatic capacitance generated between the wirings and the getter 30 having the openings 52 in Example 2 is reduced to 50% of that generated between the wirings and the getter having no penetrating portions. On the other hand, the gas adsorption performance of the getter 30 having the openings 52 is comparable to that of the getter having no penetrating portions.

According to Example 2, the electrostatic capacitance generated between the wirings and the getter 30 can be reduced in comparison with that in the case where the getter having no penetrating portions is used, without deteriorating the gas adsorption performance. As a result, a high vacuum condition near the electron-emitting devices can be achieved.

To make the electrostatic capacitance generated between the wirings and the getter further reduced, the design can be modified, for example, such that the radius of the circular opening 52 is set to 2 μm and the interval between the openings 52 is set to 0.15 μm. With that design, the electrostatic capacitance generated between the wirings and the getter 30 is reduced to 32% of that generated between the wirings and the getter having no penetrating portions. On the other hand, the gas adsorption performance of the getter 30 is held comparable to that of the getter having no penetrating portions.

Alternatively, to make the gas adsorption performance of the getter 30 further increased, the design can be modified, for example, such that the radius of the circular opening is set to 0.5 μm and the interval between the circular openings is set to 0.5 μm. With that design, the electrostatic capacitance generated between the wirings and the getter 30 is reduced to 50% of that generated between the wirings and the getter having no penetrating portions. On the other hand, the gas adsorption performance of the getter 30 is increased to about 2.5 times that of the getter having no penetrating portions.

Example 3

Example 3 is similar to Example 1 except that a snake-shaped getter having the cut grooves 53, such as those shown in FIG. 8, is formed as the penetrating portions.

In Example 3, the width of the individual cut grooves 53 is set to 1 μm, and the snake width is set to 1 μm. The electrostatic capacitance generated between the wirings and the getter 30 having the cut grooves 53 in Example 3 is reduced to 50% of that generated between the wirings and a similar getter having no penetrating portions. At the same time, an induced current is also reduced. On the other hand, the gas adsorption performance of the getter 30 having the cut grooves 53 is comparable to that of the getter having no penetrating portions.

According to Example 3, not only the electrostatic capacitance generated between the wirings and the getter 30, but also inductance can be reduced in comparison with those in the case where the getter having no penetrating portions is used, without deteriorating the gas adsorption performance. As a result, a high vacuum condition near the electron-emitting devices can be achieved.

To make the electrostatic capacitance generated between the wirings and the getter further reduced, the design can be modified, for example, such that the width of the cut groove 53 is set to 1.5 μm and the snake width is set to 0.5 μm. With that design, the electrostatic capacitance generated between the wirings and the getter 30 is reduced to 25% of that generated between the wirings and the getter having no penetrating portions. On the other hand, the gas adsorption performance of the getter 30 is held comparable to that of the getter having no penetrating portions.

Alternatively, to make the gas adsorption performance of the getter 30 further increased, the design can be modified, for example, such that the width of the individual cut grooves is set to 0.5 μm and the interval between the snake width is set to 0.5 μm. With that design, the electrostatic capacitance generated between the wirings and the getter 30 is reduced to 50% of that generated between the wirings and the getter having no penetrating portions. On the other hand, the gas adsorption performance of the getter 30 is increased to about 2 times that of the getter having no penetrating portions.

While the exemplary embodiments have been described, it is to be understood that the claims are not limited only to the exemplary embodiments described herein. The scope of the following claims is to be accorded the broadest interpretation so as to encompass all modifications and equivalent structures and functions.

This application claims the priority benefit of Japanese Patent Application No. 2008-043069 filed Feb. 25, 2008, which is hereby incorporated by reference in its entirety, as if set forth fully herein.

What is claimed is:

1. An image display apparatus comprising:

at least one electron-emitting device;

at least one wiring arranged to apply a voltage to the electron-emitting device; and a getter disposed on the wiring with an insulating layer interposed therebetween;

wherein the getter comprises a plurality of openings positioned above the wiring wherein the plurality of openings penetrate the getter such that at least the insulating layer is exposed, and wherein an area of side walls positioned above the wiring and inside the plurality of the openings is the same as or larger than an area of the plurality of openings.

2. The image display apparatus according to claim 1, wherein at least one of the openings is cylindrical, and wherein the area of the at least one opening comprises an area of a circular cross-section of that opening.

3. The image display apparatus according to claim 1, wherein a potential is applied to the getter.

4. The image display apparatus according to claim 1, wherein the getter is a non-evaporable getter.

5. An image display apparatus comprising:

at least one electron-emitting device;

at least one wiring arranged to apply a voltage to the electron-emitting device; and a getter disposed on the wiring with an insulating layer interposed therebetween;

wherein the getter comprises a plurality of cut grooves positioned above the wiring, wherein the plurality of cut grooves penetrate the getter such that at least the insulating layer is exposed, and wherein an area of side walls positioned above the wiring and inside the plurality of cut grooves is the same as or larger than an area of the plurality of cut grooves.

6. The image display apparatus according to claim 5, wherein a potential is applied to the getter.

7. The image display apparatus according to claim 5, wherein the getter is a non-evaporable getter.

* * * * *